US006260749B1

(12) United States Patent
Horovitz

(10) Patent No.: US 6,260,749 B1
(45) Date of Patent: Jul. 17, 2001

(54) SMALL ARTICLE HOLDER INCLUDING MAGNET MEANS

(76) Inventor: Eitan Horovitz, 861 Hollander Rd., Newmarket (CA), L3Y 8G7

( * ) Notice: Subject to any disclaimer, the term of this patent is extended or adjusted under 35 U.S.C. 154(b) by 0 days.

(21) Appl. No.: 09/418,491

(22) Filed: Oct. 15, 1999

(51) Int. Cl.[7] ..... A45F 5/00

(52) U.S. Cl. ..... 224/183; 224/251; 224/901; 24/3.3; 206/5

(58) Field of Search ..... 224/183, 251, 224/268, 901; 24/3.1, 3.3, 3.7, 3.8, 303; 206/5, 37; 248/683

(56) References Cited

U.S. PATENT DOCUMENTS

| | | | | |
|---|---|---|---|---|
| 822,969 | | 6/1906 | Martin et al. . | |
| 2,770,168 | | 11/1956 | Tesauro . | |
| 2,850,152 | | 9/1958 | Marrufo . | |
| 2,967,038 | | 1/1961 | Lennemann . | |
| 3,741,376 | * | 6/1973 | Brown et al. | 224/183 X |
| 4,339,045 | | 7/1982 | Bodin . | |
| 4,452,354 | | 6/1984 | Tabachnick . | |
| 4,458,384 | | 7/1984 | Arnold . | |
| 4,830,321 | | 5/1989 | Irie . | |
| 4,894,887 | * | 1/1990 | Ward, II | 224/183 X |
| 5,078,484 | | 1/1992 | Vaughn . | |
| 5,143,371 | * | 9/1992 | Strahan | 224/183 X |
| 5,186,373 | * | 2/1993 | Taylor | 224/183 |
| 5,305,934 | | 4/1994 | Grey . | |
| 5,319,838 | | 6/1994 | Eppenauer . | |
| 5,551,126 | | 9/1996 | Wallo . | |
| 5,613,661 | | 3/1997 | Seach . | |
| 5,682,653 | * | 11/1997 | Berglof et al. | 224/183 X |
| 5,758,807 | * | 6/1998 | Wright | 224/183 |
| 5,810,310 | | 9/1998 | Seach . | |
| 5,845,369 | | 12/1998 | Dunchock . | |
| 5,864,924 | | 2/1999 | Rodriguez . | |
| 5,941,487 | | 8/1999 | Keely . | |

FOREIGN PATENT DOCUMENTS

| | | |
|---|---|---|
| 661650 | 4/1963 | (CA) . |
| 793143 | 8/1968 | (CA) . |
| 851410 | 9/1970 | (CA) . |
| 876575 | 7/1971 | (CA) . |
| 950645 | 7/1974 | (CA) . |
| 1157817 | 11/1983 | (CA) . |

* cited by examiner

*Primary Examiner*—Stephen K. Cronin
(74) *Attorney, Agent, or Firm*—Martin J. Marcus

(57) ABSTRACT

A simple holder is provided for holding a desired small article to an article of clothing. The holder is provided by the operational combination of a base member of a selected appearance, the base including a magnetizable area thereon. Holding means are secured to the base member for holding a desired small article thereto or therein. The holder is in cooperative combination with a permanent magnet. The base member may be secured to the front of an article of clothing by means of magnetic attraction between the magnetizable area adjacent the front of the clothing and the permanent magnet at a corresponding area at the back of the article of clothing. The selected small article can then be held by the holding means.

14 Claims, 2 Drawing Sheets

SMALL ARTICLE HOLDER INCLUDING MAGNET MEANS

BACKGROUND OF THE INVENTION (a) Field of the Invention

This invention relates to a small article holder, namely a first member including a magnetizable portion and means for securing small articles thereto, and a second member including a permanent magnet, for magnetically securing the first member to an article of clothing.

(b) Description of the Prior Art

Millions of people wear eye glasses. However, many of them remove their eye glasses during the course of the day for various reasons. In some cases, the eye glasses are needed only for reading. In other cases, the eye glasses are needed only for seeing objects at a distance. In still other cases, individuals simply remove their eye glasses to perform other activities or simply to give their eyes a rest. In each case, the user requires a place to hold or store the eye glasses when they are not used.

Eyeglasses, when not worn, are often carried in a bulk case or a pouch for protection and may be placed in a pocket or handbag. However, when glasses are frequently put on and taken off, it is desirable to have them in a more easily and quickly accessible position. Thus, glasses may be hung in front of the user by an elastic cord encircling the neck and attached to the end portions of each temple piece. That arrangement is somewhat unsatisfactory because the eyeglasses remain open and rest against the chest of the wearer, and with an especially active person, the eyeglasses may swing about excessively and be damaged as well as interfere with or restrict a person's movement. More frequently, people tend to merely fold up their eyeglasses and slip them in a shirt or coat pocket where they may be scratched by other material carried in the pockets or fall out causing possible damage.

Chains or strings are commonly used which move about the head or neck of a user and hold the eye glasses when they are removed from the user's head. As chains are fully functional to hold eye glasses when not in use, they frequently suffer from practical or aesthetic shortcomings that limit their use. Individuals dressed in casual clothes may, for aesthetic reasons, prefer not to use eye glass chains. It is also well known to protect eyeglasses that are only worn part-time by attaching the ends of a flexible band to both temples and using the band to suspend the spectacles from the wearer's neck. Various improvisations may be made to hold and support eye glasses when not in use, though they frequently suffer from an inability to secure the eye glasses, or are aesthetically desirable to many users.

Men, in particular, prefer to use a case which can be conveniently carried in a shirt breast pocket. If such cases are not equipped with a clasp or clip of some sort, then the case is very likely to fall from the pocket, particularly when the owner bends over. Moreover, because eyeglass cases are relatively narrow, they are likely to fall askew in the pocket unless held.

In order to retain eyeglass cases and the like in a pocket, resilient clips are commonly used. These clips depend, for their effectiveness, on the gripping capability of the clip acting on the pocket material disposed between the clip and the case. If the resilience of the clip is too great, then the case cannot easily be withdrawn from the pocket with one hand, and if this is attempted, there is a tendency for the clip to drag or tear the pocket. Alternatively, if the clip resilience is insufficient, then the clip is ineffective. Further, each clip is normally designed to suit one thickness of pocket material and is not adaptable to a different thickness of material. Thus, a clip design for a shirt pocket is likely to be unsuitable for use with a jacket or vest pocket.

When users of eyewear remove the eyewear, they wish to keep it conveniently located to be readily replaced back on the face of the user when needed. Some users typically place their removed eyewear in their shirt pocket, in a container or purse, or lay the eyewear down on a convenient surface. Some hang eyewear from the neckline of their shirt or blouse by extending one of the temples inside the shirt or blouse, thereby hanging the eyewear on the front of the shirt or blouse.

Sunglasses that are not being worn on the user's face are often suspended from the front of an article of apparel (e.g., by inserting a temple of the sunglasses into the neckline of the garment).

Thus, it is seen that one of the most frequently misplaced articles in and about a home, office, or the like, are keys and glasses. Frequently upon entering a room, a person has glasses and keys in his or her hands and will place them on the nearest, most available location. Upon leaving the room or preparation for leaving the room, the person immediately recognizes the need for the glasses and the keys and immediately begins a search for them. Since each room is different and the location of a place for placement of the glasses and keys is different in each room, it frequently takes several minutes to locate the keys and or the glasses.

In the above-described solutions to this problem, the glasses may be hung in front of the user by an elastic cord encircling the neck and attached to the end portions of each temple piece. This is somewhat unsatisfactory for carrying the eyeglasses as they remain opened and rest against the chest of the wearer. Especially with a active person, the eyeglasses may swing about excessively and be damaged as well as interfere with or restrict a person's movements. More frequently, people tend to merely fold up their eyeglasses and slip them into a shirt or coat pocket. The loose eyeglasses thereupon may be scratched by other material carried in the pockets or may fall out and be broken.

Other known methods of retaining eyewear convenient to the user include suspending the eyewear from a cord looped around the neck of the user. Such methods include various means of attaching the ends of the cord to the earpieces of the eyewear. These devices are not easily removable from the eyewear and, therefore can become unsightly when the eyeglasses are worn by the user. That is, the cord often extends from the ears of the user where it is highly visible to others. Therefore, there is a need for a device for hanging a pair of eyeglasses about the neck of a user which can be readily disconnected from the eyeglasses when it is desired to use the eyeglasses.

One of the known devices in the prior art utilizes a form of magnetized clip or clasp to effectuate the holding action. However, in such device, the clip is structurally rigid and cannot be utilized as a strap to facilitate removal of the case. Further, the magnetic action provides a clamping function for an abrasive material provided on the underside of the clip, and in this sense, augments, rather than provides, the holding action.

It is known to secure sheets like objects as pads, drawings and the like to smooth panels of magnetizable material by clamping these objects beneath a magnetized piece to a all panel. With a convenient form, for example a hooked form, other kind of objects can also be attached to such panels.

Furthermore objects such as coin receptacles, cigarette boxes and the like having an incorporated magnetized piece have been known for the same use.

The prior art is complete with patents which are directed to various ways for holding small articles, e.g., eyeglasses, sunglasses, keys, etc.

U.S. Pat. No. 822,969 patented Jun. 12, 1906, by J. S. Martin et al., provided a combined badge and watch guard. Such device included a body having a rearwardly-extending marginal flange which was provided with a transverse recess at one point therein. A bar extended through the recess and was secured to the body. It had an eye at one end which extended beyond the body. A threaded pin extended rearwardly of the bar at its inner end. A clamp-nut engaged the eye.

Another such patent was U.S. Pat. No. 2,850,152, for a "Combined fountain Pen, Spectacles and Comb Case". This device includes a pocket for holding the eyeglasses and pocket clip for securing the pocket to clothing.

U.S. Pat. No. 2,967,038, patented Jun. 3, 1961 by L M. Lennemann, provided a supporting device. The patented supporting device included a magnetizable metal member, with sheet material covering the marginal edge portions of the front of the metal member and the back thereof. A magnet was secured to the front of the metal member. The securing means for the magnet included a loop of material in which the magnet was held, the ends of the loop being secured beneath the sheet material covering the marginal edge portion of the front of the metal member at one side thereof. Adhesive was supplied on the exposed surface of the sheet material covering the back of the magnetizable metal member. In that way the supporting device was adherable to a surface.

U.S. Pat. No. 4,339,045, patented Jul. 13, 1982, by L. Bodin provided a switch plate article holder. The patented device included a mounting plate which was adapted to be detachably secured to a wall-mounted electrical switch. The mounting plate included an arm which was spaced outwardly from the mounting plate and which extended horizontally, parallel to the plate for receiving and holding a key ring. A first support block member supported the arm on the mounting plate. A vertically-open, horizontally-elongated slot extended across the face of the plate for receiving the side piece of a pair of glasses. A stop member extended upwardly from the upper surface at the outer end of the arm. A vertically-oriented bore was formed in the first block member for receiving and holding a pencil.

U.S. Pat. No. 4,452,354, patented Jun. 5, 1984, by W. Tabachnick provided an eyeglass holder. That eyeglass holder included a tube of flexible plastic having oppositely-disposed wide side walls and substantially-narrower end walls to that the inner periphery of the tube was elongated and generally-rectangular. The side walls were sufficiently flexible so that one side wall may be deformed into contact with the other side wall by application of finger pressure. It was sufficiently-resilient so as to cause the side walls to return to their original shape to be generally-parallel to one another. Means were attached to the other wide side wall for adhesively-securing the tube to a support surface.

U.S. Pat. No. 4,458,384, patented on Jul. 10, 1984, by T. R. Arnold provided a holder for eyeglasses. Such holder included temples including a body having a pair of spaced end parts and a planar central part interconnecting the end parts. Each end part included a single, rigid, substantially-non-yieldable wire segment having a pair of opposed ends which were rigidly secured to the central part and which were shaped to present a pair of wire sides and a wire cross-piece integral with the outer ends of the wire sides. The wire sides were curved out of the plane of the central part and diverged relative to each other as their outer ends approached. The wire sides, the wire crosspiece of each wire segment and the central part defined axially-opposed closed loops. The closed loops were aligned with each other and were too small to receive a pair of eyeglasses. The wire sides were curved out sufficiently so that the loops were large enough for loosely receiving, in a grippless manner, a temple of a pair of eyeglasses. The temple, when so received in the closed loops, extended longitudinally of the central part and was releasably held by the end parts. Means were provided on the central part for attaching the body to a garment.

U.S. Pat. No. 4,830,321, patented May 16, 1989, by K. Irie provided a magnetic holder. The patented magnetic holder had a movable body which was made of a material upon which a magnet can function. The movable body was attached at its centre to the centre of the upper surface of the magnet. The lower surface of the magnet was attachable to any surface upon which a magnet can function. The surface of the movable body which faced the magnet was divided into sections radially centering on the centre point of that surface. When the movable body was caused to move so that one of its sections was attached to the magnet by magnetic force, the other sections were separated from the upper surface of the magnet. Paper was held to the surface upon which the magnetic holder was placed by the clipping part on the end of the section of the movable body which was attached to the magnet.

U.S. Pat. No. 4,894,887, patented Jan. 23, 1990, by S. Ward II, provided an eyeglass retainer. Such eyeglass retainer included a pair of eyeglasses and an eyeglass retainer for supporting the pair of flat folded eyeglasses from clothing of an eyeglass user. The retainer included a pair of eyeglasses including an eyeglass frame and lens, the eyeglass frame including a pair of temple sidepieces for supporting the eyeglasses on the head of the user. The eyeglass retainer included a clip portion having first and second elongated finger members which were arranged in opposing relationship and which were interconnected to an upper region with downwardly-extending distal ends which were resiliently biased together to clip on clothing of an eyeglass user. The eyeglass retainer further included a non flaccid transverse looped hanger portion which was formed integra with the first finger member and which extended outwardly therefrom, the hanger portion being disposed intermediate the upper region and the distal end of the clip portion and was adapted to receive the temple sidepiece of the pair of eyeglasses. Means were associated with the hanger portion to support and maintain the eyeglasses in a controlled pendulous orientation. Such means included a substantially-oval cross-sectional-shaped opening extending vertically through the hanger portion with a support edge for abutting a portion of the eyeglasses. The opening and support edge cooperated with the temple sidepiece. The opening had particularly-specified dimensions to accommodate limited forward and backward movement of the eyeglasses relative to the hanger portion of the eyeglass retainer. In that manner, the eyeglasses were said to be maintained in a substantially-downward suspended inclination.

U.S. Pat. No. 5,078,484, patented Jan. 7, 1992, by M. Vaughn, provided a lapel pen, eyeglass and pillbox organizer. Such organizer included an elongate, vertically-aligned rigid support shaft. The rigid support shaft included a hook member which was mounted at a lower terminal end of the support shaft for the support of the eyeglass pair. The hook member was laterally-directed relative to an axis which was defined by the support shaft. A camouflage head was integrally-mounted to an upper terminal end of the support shaft and was orthogonally-oriented to the axis of the support shaft and the hook member. A storage container was coaxially mounted relative to the camouflage head and was orthogonally oriented relative to the axis of the support shaft.

U.S. Pat. No. 5,305,934, patented Apr. 26, 1984, by M. Grey, provided a combined tool and eyeglass holder. That eyeglass holder included an elongated flexible member which was positionable about the neck of the user, the elongated member having first and second terminal ends. A container was provided having a generally-hollow interior cavity and an opening for accessing the cavity, the first and second terminal ends of the elongated member being secured to the container. A tool was at-least-partially positioned within the cavity, the tool being sized to pass through the opening for allowing the user to access and use the tool. A loop member was provided which was separate from the elongated flexible member. The loop member extended from the container and defined an aperture for receiving a temple of the pair of eyeglasses therethrough, to thereby support the pair of eyeglasses on the device.

U.S. Pat. No. 5,319,838, patented Jun. 14, 1994, by R. I. Eppenauer, provided an eyeglass holder. That eyeglass holder included a continuous loop of substantially-rigid material which was bent to form a first portion and a second portion which was substantially-perpendicular to the first portion, so that the first and second portions formed an opening therebetween. The first portion was provided with a pin and clasp whereby the eyeglass holder was pinnable to any piece of clothing in any position. The opening was formed such that a temple side-piece of the pair of eye glasses may be hung over the periphery of the continuous loop on the second portion and was supported in a pendulous position in a manner. The pair of eye glasses maintained a substantially-downward orientation regardless of the orientation of the eyeglass holder.

U.S. Pat. No. 5,552,126, patented Sep. 3, 1996, by W. H. Walde, provided a button-on holder for eyeglasses. Such holder was specially adapted for suspending a pair of eyeglasses from a button which was sewn onto the front of an article of upper body apparel. The hanger included a thin flexible sheet of material having an elongated throughhole therethrough. The throughhole included a thread-retaining portion which was adjacent to an upper end thereof, the thread-retaining portion having a diameter which was greater than a threading-hole spacing of the button. A temple-retaining portion was provided adjacent to a lower end thereof, the temple-retaining portion being wider than a temple of the pair of eyeglasses, the temple-retaining portion including centering-angle adjacent the lower end. A locking slot was provided intermediate the thread-retaining portion and the temple-retaining portion, the locking slot being narrower than the threading-hole spacing.

U.S. Pat. No. 5,613,661, patented Mar. 25, 1997, by E. Seach, provided a holder for eyeglasses. Such holder included an enclosure having an opening therein. An access element was movably positioned within the enclosure. An eyeglass engagement body member extended from the opening in the enclosure in spaced overlapping relation to a portion of the access element. Means were provided for resiliently-positioning the access element within the enclosure. The eyeglass engagement body member and the movable access element together surrounded an ear piece of the pair of eyeglasses to hold the eyeglasses.

U.S. Pat. No. 5,810,310, patented Sep. 22, 1998, by E. J. Seach, provided a holder for eyeglasses. The patented eyeglass holder included an enclosure having an opening therein. An access element was movable positioned within the enclosure. An eyeglass engagement body member extended from the opening in the enclosure in spaced, overlapping relation to a portion of the access element. A coiled spring was provided within the access element for resiliently-positioning the access element within the enclosure. Spring means were provided in communication with the eyeglass engagement body member. Guide means were provided within the enclosure which were engageable on the eyeglass engagement body member. The engagement body member and the movable access element together surrounded an ear piece of said pair of eyeglasses to hold the eyeglasses.

U.S. Pat. No. 5,845,369, patented Dec. 8, 1998, by R. S. Dunchock, provided an eyeglass holder. The patented eyeglass holder included a pin assembly which was engageable to the fabric. The pin assembly included a substantially-planar member having an outer, eye-glass-frame-striking surface and an inner fabric-abutting surface. The pin assembly further included a ring member which extended from the outer striking surface and which defined an eye-glass-frame-receiving aperture therebetween. The pin assembly still further included a pin extending normally from the inner fabric abutting surface. The pin assembly still further included a clutch for receiving and engaging the pin, and a clutch facing which was secured to the clutch and which extended circumferentially thereabout. The clutch facing was resiliently-deformable against the fabric upon engagement of the eyeglasses to the ring member.

U.S. Pat. No. 5,864,924, patented Feb. 2, 1999, by L. Rodriguez, provided an eyeglass holder. The patented eyeglass holder included an elongated, substantially-rigid upright member connected at an upper end thereof to a first end of an elongated, substantially-rigid lateral member which extended laterally in one direction from the upright member, the lateral member having sufficient length supportively to receive the bridge of the eyeglasses there-atop with the temples facing downwardly. A pivotal connection was provided between one end of an elongated, substantially-rigid bridge retaining member and a second end of the lateral member. Biasing means were provided at the pivotal connection for maintaining the bridge retaining member either in an open position, upwardly-extending from the lateral member, or in a closed position spaced above, and substantially-coextensive with, the lateral member and defining a bridge-receiving-and-retaining slot therebetween. Retaining means were provided for supportively-attaching the eyeglass holder to a user, wherein the upright member was held substantially-vertically against the user with the lateral member extending substantially-horizontally away from the user. The bridge of the eyeglasses thus rested atop the lateral member and was retained by the retaining member when in the closed position.

U.S. Pat. No. 5,941,487, patented Aug. 24, 1999, by M. V. Keely, provided a retainer for holding eyeglasses. The patented retainer included a clamp, having a first clamp member and a second clamp member, the first clamp member and the second clamp member being pivotally attached together. Means were attached to the first clamp member and to the second clamp member, for biasing a first end of the first clamp member and a first end of the second clamp member together. A retainer ring was mounted to a second end of the first clamp member. The retainer ring was rotatable to a position wherein the retainer ring extended in a plane traversing a plane in which a temple piece extended. The temple piece was inserted through the retainer ring.

Canadian Patent No. 661,650, issued Apr. 23, 1963, to J. R. Morgan et al. provided a magnetic box holding bracket. The patentee provided an adjustable bracket including a pair of T-shaped, co-acting slide devices, the shaft of one slide being provided with channels to receive the shaft of the other. Each device included a crossbar on one end thereof. A pointed prong was provided on each extremity of said crossbar and extended in the same direction as the shaft. The pair of prongs on one device were arranged in opposed relation to the pair of prongs on the other device. The prongs were laterally offset from the crossbars to provide clearance for the wall of a carton impaled on said prongs. Magnets were attached to the extremities of the crossbars on the surface opposite the prongs.

Canadian Patent No. 793,143, issued Aug. 27, 1968, to J. M. Margulis, provided a wall and ceiling hanger. The patented hanger included a rigid, hollow, box-like housing open on one side thereof. A magnet conforming to the shape of the housing was fixedly secured within the housing. The magnet had one face thereof adjacent the open side of the housing. First and second sockets were struck out from the side of the housing opposite the open side, said sockets being spaced apart to define a slot therebetween, the sockets being in open communication across the slot and with the interior of the housing. Hanger means were provided for hanging an object, the hanger means having an extending elongated portion. One end of the elongated portion was connected to a T-bar intermediate the ends of the T-bar. The T-bar was rotatably-mounted in the sockets with the elongated portion extending through the slot. The hanger means were rotatable through 180° within the slot.

Canadian Patent No. 851,410, issued Sep. 15, 1970, to P. T. Davison, provided a magnetic clothes pin. The patented magnetic clothes pin comprised a length of flexible material having pockets at each end thereof. A magnet was disposed in one of the pockets. A magnetically-attractable plug was disposed in the other one of the pockets. The strap was easily bendable so that, when draped over a supporting structure, the magnet and the plug were attracted to one another.

Canadian Patent No. 876,575, issued Jul. 27, 1971, to R. Doppler, provided a device for holding objects to a smooth panel. The patented device included a foil consisting at-least-partially of magnetizable or magnetic material. One surface of the foil was provided with an adhesive coating for securing the foil to a panel. A holder made of at-least-partially of a magnetic or magnetizable material was provided for holding an object on the foil.

Canadian Patent No. 950,645, issued Jul. 9, 1974, to R. G. Brown et al., provided a pocket holder with a magnetic clasp. The patented pocket holder included a container member which was adapted to be received inside the pocket and included a front panel, a rear panel and a first magnetically-attractive element which was carried by the front panel. A flexible hand strap clasp member was provided including upper and lower portions and hinge means which interconnected the upper and lower portions. The upper portion was attached to the front panel. The lower portion included a second, magnetically-attractive element which was adapted to be disposed outside of the pocket. The lower portion was elongate and was substantially-narrower than the front panel. The hinge means permitted substantially-universal movement of the hand strap clasp member relative to the front panel. At least one of the magnetically attractive elements was a permanent magnet, so that the container and clasp members were adapted to be magnetically alignable on opposite sides of the pocket. The flexible clasp was attachable to a pocket-engaging backing piece carrying a magnetically-attractive element. An identification photograph was attachable to the front of the clasp to provide a convenient identification means without the necessity of using pins or the like.

Canadian Patent No. 1,157,817, issued Nov. 29, 1983, to T. Morita, provided a magnetic fastener using a permanent magnet. Such magnetic fastener included a magnetic means having a first side and a second side of opposite polarities, and at least one peripheral edge. A cover plate of non-magnetic material was provided which configurationally-conformed and was adjacent to the second side and at least one peripheral edge of the magnetic means. A first ferromagnetic material means was positioned adjacent to the first side of the magnetic means, and had at least two prongs which were rigidly secured thereto and which were provided to attach the first ferromagnetic means to a first surface. Means were provided for securing edge portions of the first ferromagnetic material means to regions of the cover plate of non-magnetic material which were in the vicinity of at least one peripheral edge. A second ferromagnetic material means was removably-positioned against the non-magnetic cover plate. That second material included a base plate adjacent to the non-magnetic plate. An elongated projection was rigidly attached to the base plate. The elongated projection extended toward, and contacted, the first magnetic material means and a plurality of prongs which were rigidly secured to the base plate and which were provided to attach the second ferromagnetic means to a second surface. The magnetic means had a recess in at least one peripheral edge which was substantially commensurate in shape with, and was adapted to receive, the elongated projection.

SUMMARY OF THE INVENTION

(a) AIMS OF THE INVENTION

In spite of the above-identified patents, the problem remains that it would be desirable to provide some device or means be available for holding and quickly locating keys, glasses, and the like.

The use of chains or strings suspend or loosely emplace eyeglasses, which commonly fall to the ground when the wearer bends forward at the waist. Thus the above-described approaches to protecting eyeglasses had drawbacks. Some people do not like feeling a band flopping about on the back of the neck. Eyeglass cases can be forgotten, and usually require the user to either wear a shirt with a pocket or to carry a purse.

All of these methods of storing eyewear have problems. Many shirts do not have pockets, or if they have pockets, when the user bends over the eyewear is in danger of slipping out. Purses or containers for eyewear are frequently not readily available when the user needs to make immediate use of his eyewear, and when the eyewear is laid on a nearby surface it frequently is misplaced or lost entirely.

Moreover, in view of the drawbacks of the holders mentioned above, a need has arisen for an improved holder which is simple and rugged in construction, is inexpensive to produce and can be quickly and easily attached to and separated from a garment yet allowing a pair of eyeglasses to be positively held without any attachment to or enclosure of the eyeglasses. Accordingly, an eyeglass retainer which will support the eyeglasses in a safe, accessible and compact manner would be a decided advance in the state of the art.

It is therefore one object of the present invention to provide an arrangement wherein simple mounting and magnetization can be used to hold small articles.

A second object of this invention is to provide an eyeglass holder which can be attached to a garment to allow the eyeglasses to be held, yet to be accessible at all times while the holder is worn on the garment.

A third object of this invention is to provide a carrying device for eyeglasses which can be conveniently attached to the clothing of an eyeglass user and which will securely support the glasses.

A fourth object of this invention is to provide a small article holder which may be easily and efficiently manufactured and marketed.

A fifth object of this invention is to provide a small article holder which is of a durable and reliable construction.

A sixth object of this invention is to provide such a small article holder which can be manufactured at a low cost with regard to both materials and labour, and which accordingly economically available to the buying public.

A seventh object of this invention is to provide a small, ornamental eyeglass holder to provide eyeglass support and that further may be attached to any piece of clothing in almost any position.

An eighth object of this invention is to provide such a holder with means by which small objects, e.g., identification badges may be suspended.

A ninth object of this invention is to provide a novel holder for supporting eyeglasses, and the like, which is constructed in a manner so that it may be rapidly produced in an inexpensive manner.

A tenth object of this invention is to provide an eyeglass holder for removable attachment to a garment, a shirt or blouse.

An eleventh object of the present invention is to provide a magnetic holder which requires only one magnet, which is inexpensive to manufacture, and by means of which a selected small article can be easily held to, and removed from, the surface which cooperates with a magnet.

A twelfth object of this invention is to provide an improved magnetic small article holder.

A thirteenth object of the present invention to provide an article holder for keys, glasses, which includes integral means thereon for holding eyeglasses keys, etc.

A fourteenth object of this invention is to provide a device for securing eyeglasses against dislodgement by an active user, which also provides a more aesthetically-pleasing construction that can appear as an ornament device.

A fifteenth object of this invention is to provide such a device whose construction allows the eyeglass holder to serve its intended function, without detracting from the appearance of the fabric to which it is attached, by distributing the load of the eyeglasses over a broader area of the fabric to avoid or mitigate an unsightly stretching or pulling of the fabric about the eyeglass holder.

A sixteenth object of this invention is to provide an article holder for holding keys, glasses, and the like which is adapted to be magnetically secured to an article of clothing to receive and support articles, e.g., keys, glasses, and the like in a convenient place.

(b) STATEMENT OF INVENTION

By this invention, a holder is provided for holding a desired small article to an article of clothing. Such holder includes a base member of a selected appearance, the base including a magnetizable area thereon. Holding means are secured to, or are integral with, the base member for holding a desired small article thereto or therein. This device is in cooperative combination with a permanent magnet. The base member may be secured to the front of an article of clothing by means of magnetic attraction between the magnetizable area adjacent to the front of the clothing and the permanent magnet at a corresponding area at the back of the article of clothing, so that the small article can be held by the holding means.

(c) OTHER FEATURES OF THE INVENTION

By a first feature of this broad aspect of this invention, the magnetizable area comprises a steel disc which is permanently attached to the rear face of the base member.

By a second feature of this broad aspect of this invention and/or the above feature thereof, the holding means comprises a ring which is permanently secured to said base member.

By a third feature of this broad aspect of this invention and/or the above feature thereof, the holding means comprises an open-ended, extending arm.

By a fourth feature of this broad aspect of this invention and/or the above features thereof, the magnetic holder is in the shape of a miniature pair of eyeglasses, and the desired small article is a pair of eyeglasses.

By a fifth feature of this broad aspect of this invention and/or the above features thereof, the magnetic holder is in the shape of a key and the desired small article is a key.

Figure 1:
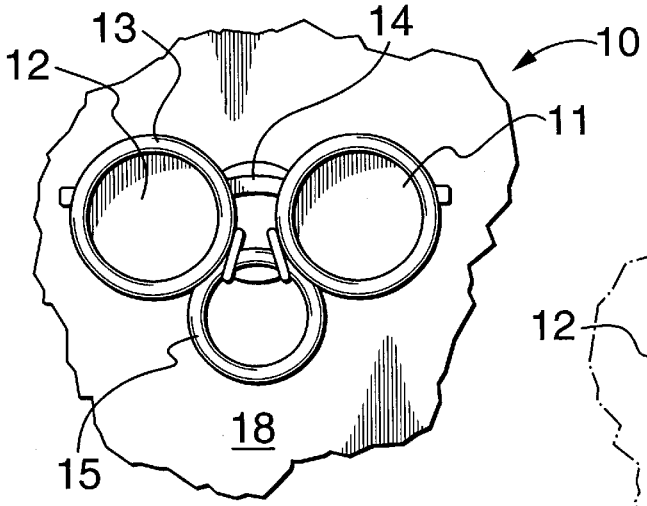
FIG. 1 is a partial view of the magnetic holding device of one aspect of the present invention, which is magnetically-attached to an article of clothing.
Figure 2:
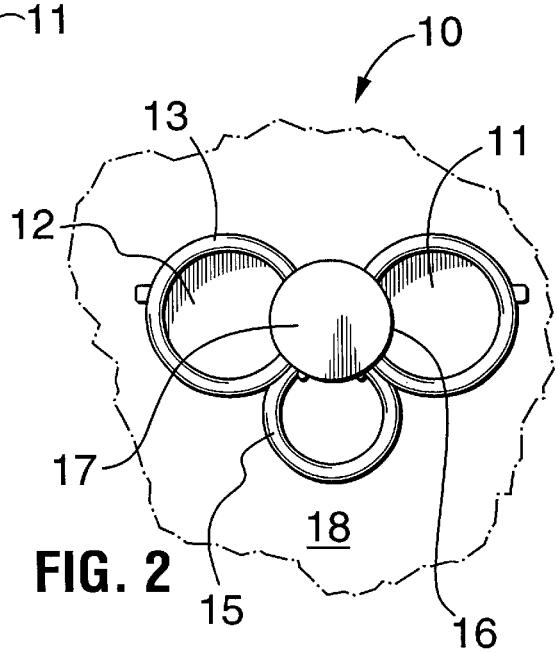
FIG. 2 is a rear view of the holding device of the aspect of FIG. 1, which is magnetically-attached to an article of clothing.
Figure 3:
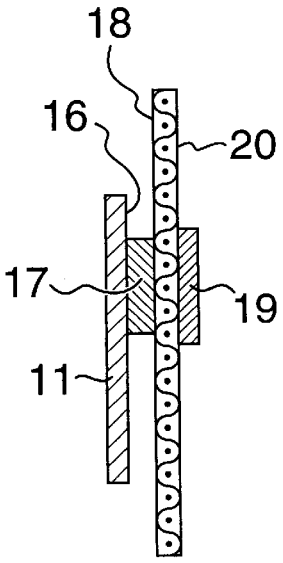
FIG. 3 is a transverse cross-sectional view of the device of the aspect of FIG. 1 which is magnetically-attached to an article of clothing.

DESCRIPTION OF PREFERRED EMBODIMENTS (a) DESCRIPTION OF FIG. 1, FIG. 2 AND FIG. 3

As seen in FIG. 1, FIG. 2 and FIG. 3, the device 10 of one embodiment of this invention includes a base member 11 of any desired decorative shape. As shown, it is shaped as a miniature pair of eyeglasses, with two pseudo lenses 12 in a frame 13 including a bridge 14. However, the shape can be provided as any piece of decorative jewellery traditionally in use as a pin or pendant. Secured to the base member 11 is a mounting device in the form of a ring 15.

The base member 11 may be made of any suitable decorative material, e.g., a synthetic plastic material, i.e., polyvinyl chloride, polyethers, polyethylene, nylon, etc., anodized aluminum, silver, or gold, etc. It is essential that the rear face 16 of the base member 11 be provided with an area which is magnetizable, e.g., a steel disc 17.

Figure 5:
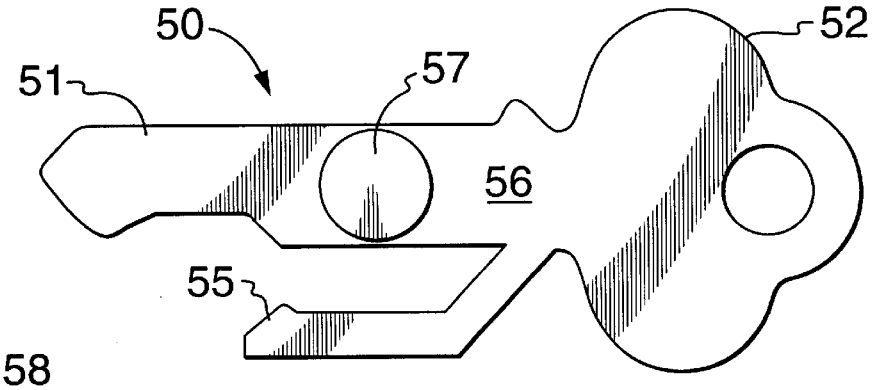
FIG. 5 is a rear view of the holding device of another aspect of the present invention.
Figure 7:
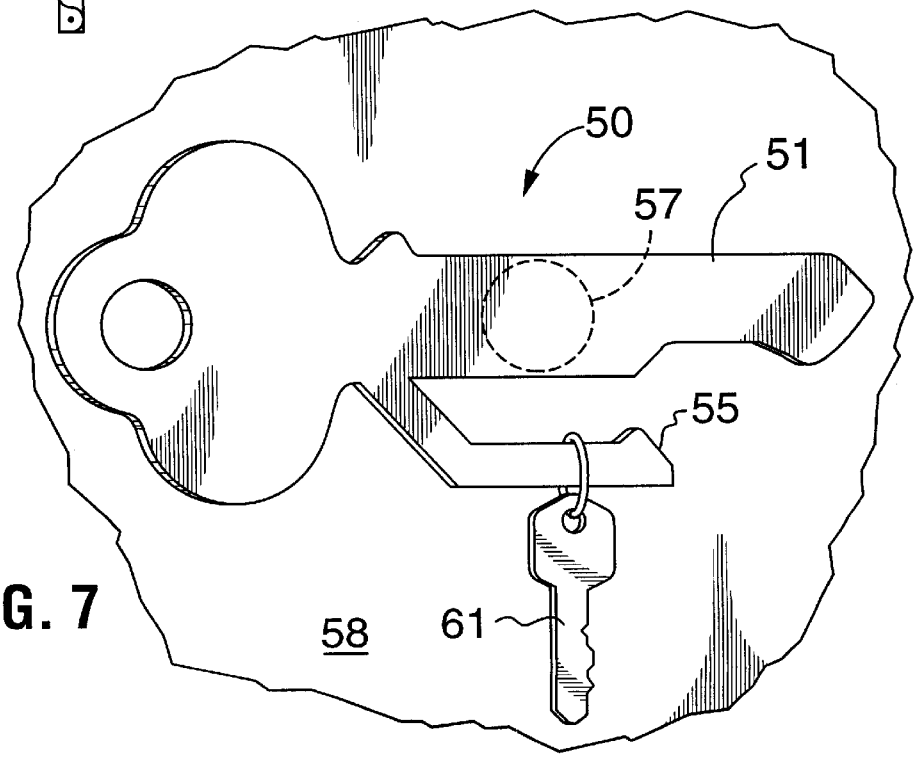
FIG. 7 is a frontal view of the holding device of the aspect of FIG. 5, which is magnetically-attached to an article of clothing, and in use, holding a key.

(b) DESCRIPTION OF FIG. 5 AND FIG. 7

As seen in FIG. 5 and FIG. 7, the device 50 of a second aspect of the invention includes a base member 51 which is shaped in the decorative form of a key 52. Secured to the base member 51 is a mounting device in the form of an arm having an extending end 55.

As in the first embodiment of FIGS. 1 to 3, the base member 51 may be made of the same type of decorative material. It is also essential, however, that the rear face 56 of the base member 51 be provided with an area which is magnetizable, e.g., steel disc 57.

Figure 4:
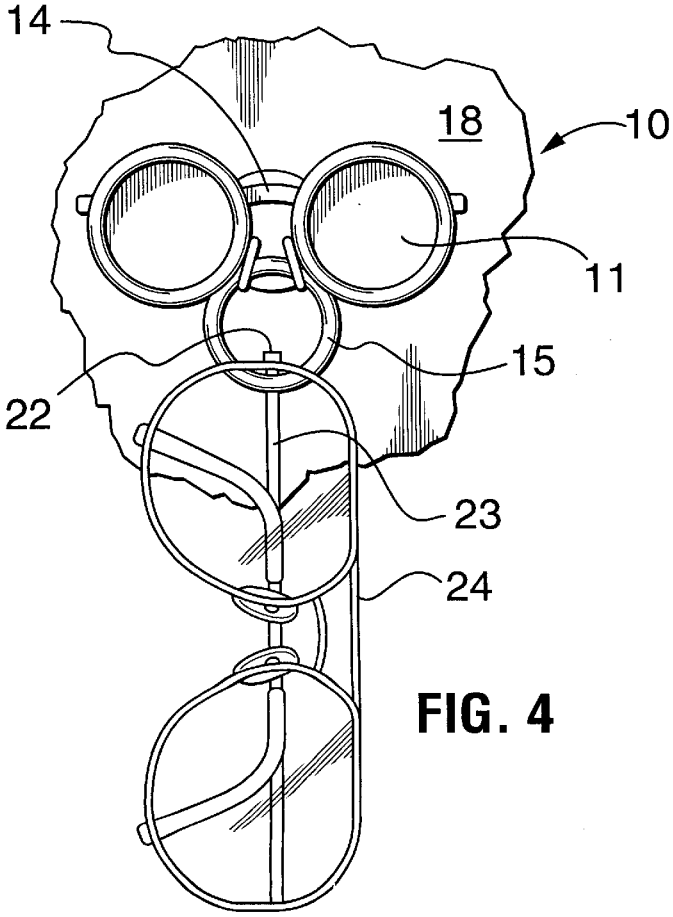
FIG. 4 is a frontal view of the holding device of the aspect of FIG. 1 in use holding eyeglasses.

USE OF THE INVENTION (a) DESCRIPTION OF FIG. 4

In use, the base member 11 is bought into contact with an article of clothing 18, with its rear face 16 and steel disc 17 adjacent the article of clothing 18. Then a disc-shaped, permanent magnet 19 is brought close to the rear 20 of the article of clothing 18. The magnetic attraction holds the device 10 to the article of clothing 18.

As seen in FIG. 4, eyeglasses 21 are hung by means of the hinge 22 between the temples 22 and the frame 23, by hooking the temple 22 through the ring 15.

Figure 6:
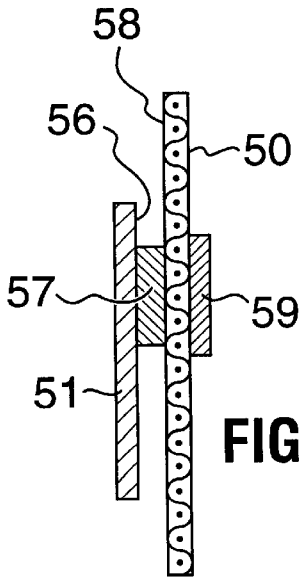
FIG. 6 is a transverse cross-sectional view of the device of the aspect of FIG. 5, which is attached to an article of clothing.

(b) DESCRIPTION OF FIG. 6

In use, as seen in FIG. 6, the base member 51 is brought in contact with an article of clothing 58 with its rear face 56 and steel disc 57 adjacent to the article of clothing 58. Then a disc-shaped permanent magnet 59 is brought close to the rear 60 of the article of clothing 58. The magnetic attraction holds the device 50 to the article of clothing 58.

As seen in FIG. 6, a key 61 is held by means of having its key ring 62 placed over the extending arm 55.

CONCLUSION

While the invention has been exemplified as a decorative magnetic holder for eyeglasses and keys, it may be used, with suitable modifications, to hold pencils, pens identification photographs and/or badges, etc.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What is claimed is:

1. An assembly for holding an article to an article of clothing, comprising the operative combination of:

(a) a monolithic planar rigid base member;

(b) a non-magnetic, but magnetizable, area on a rear face of said base member;

(c) a holding member which is secured to, or is integral with, a front face of said base member; and (d) a separate magnet;

wherein:

(i) when said rear face of said monolithic planar base member is placed against a front face of said article of clothing; and (ii) when said separate magnet is placed against a back face of said article of clothing at a position opposite to said magnetizable area on said rear face of said base member;

said monolithic planar base member is configured to be secured to said front face of said article of clothing by means of magnetic attraction between said magnetizable area on said rear face of said base member and said magnet; and whereby said article may be held to said article of clothing non-magnetically, but by said holding member.

2. The assembly as claimed in claim 1, wherein said magnetizable area comprises a steel disc which is permanently attached to said rear face of said base member.

3. The holder as claimed in claim 2, wherein said holding means comprises a ring which is permanently secured to said base member.

4. The holder as claimed in claim 2, wherein said holding means comprises a ring which is permanently secured to said steel disc.

5. The holder as claimed in claim 2, wherein said holding means comprises an extending arm which is permanently secured to said base member.

6. The holder as claimed in claim 2, wherein said holding means comprises an extending arm which is permanently secured to said steel disc.

7. The assembly as claimed in claim 2, in combination with a pair of eyeglasses; and wherein said holder is of a shape which similar to said pair of eyeglasses.

8. The assembly as claimed in claim 2, in combination with a pair of eyeglasses; and wherein said holder is of a shape which is similar to said pair of eyeglasses.

9. The assembly as claimed in claim 2, in combination with a pair of eyeglasses; and wherein said holder is of a shape which is similar to said pair of eyeglasses.

10. The assembly as claimed in claim 2, in combination with a key; and wherein said holder is of a shape which is similar to said key.

11. The assembly as claimed in claim 2, in combination with a key: and wherein said holder is of a shape which is similar to said key.

12. The assembly as claimed in claim 2, in combination with a key; and wherein said holder is of a shape which is similar to said key.

13. The assembly as claimed in claim 2, wherein said holding member comprises a hanger ring, whereby a temple sidepiece of a pair of eyeglasses may be suspended from said hanger ring.

14. The assembly as claimed in claim 2, wherein said holding member comprises a depending but freely-extending arm, whereby a key ring to which a key is secured may be suspended from said arm.

* * * * *